US011845086B2

(12) United States Patent
Rogers et al.

(10) Patent No.: US 11,845,086 B2
(45) Date of Patent: Dec. 19, 2023

(54) MACHINE FOR REDUCING THE SIZE OF FEED MATERIAL

(71) Applicant: Eco Green Equipment, LLC, North Salt Lake, UT (US)

(72) Inventors: Ted Bushman Rogers, West Haven, UT (US); Michael Bradley Swenson, North Salt Lake, UT (US); Riley Bateman, Alpine, UT (US); Jarom Groat, Clinton, UT (US)

(73) Assignee: Eco Green Equipment, LLC, North Salt Lake, UT (US)

( * ) Notice: Subject to any disclaimer, the term of this patent is extended or adjusted under 35 U.S.C. 154(b) by 0 days.

(21) Appl. No.: 17/108,271

(22) Filed: Dec. 1, 2020

(65) Prior Publication Data

US 2022/0168748 A1 Jun. 2, 2022

(51) Int. Cl.

| | |
|---|---|
| ***B02C 18/18*** | (2006.01) |
| ***B02C 18/10*** | (2006.01) |
| ***B02C 18/24*** | (2006.01) |
| ***B02C 23/16*** | (2006.01) |

(52) U.S. Cl.
CPC ..... *B02C 18/18* (2013.01); *B02C 18/10* (2013.01); *B02C 18/24* (2013.01)

(58) Field of Classification Search
CPC ..... B02C 18/18; B02C 18/10; B02C 18/24
See application file for complete search history.

(56) References Cited

U.S. PATENT DOCUMENTS

| | | | | |
|---|---|---|---|---|
| 5,379,951 | A * | 1/1995 | Hughes | B02C 18/067 241/278.1 |
| 2012/0056025 | A1* | 3/2012 | Nybo | B02C 18/24 241/36 |
| 2019/0059439 | A1* | 2/2019 | Richmond | A24C 5/44 |
| 2020/0353475 | A1* | 11/2020 | Brinkmann | F04D 7/045 |

* cited by examiner

*Primary Examiner* — Matthew Katcoff
*Assistant Examiner* — Mohammed S. Alawadi
(74) *Attorney, Agent, or Firm* — Travis Banta; Loyal IP Law, PLLC

(57) ABSTRACT

A machine includes a motor; and a transmission to drive a knife plate. The knife plate includes a plurality of knife blades. The machine further includes a die plate. The knife plate and the die plate interface at a cutting edge of the knife plate. The machine cuts feed material from larger sized pieces to smaller pieces by forcing the material through the die plate and cutting it with the knife plate.

17 Claims, 8 Drawing Sheets

MACHINE FOR REDUCING THE SIZE OF FEED MATERIAL

TECHNICAL FIELD

This disclosure relates to industrial machines used to reduce the size of solid feed material. More specifically, the disclosed size reduction machine operates at high efficiency, and it is useful to reduce the size of the feed materials. A variety of common feed materials may be reduced in size including rubber, plastic, wood, paper, biomass, and waste.

BACKGROUND

Different industrial machines are available to reduce the size of material for use or recycle. Such machines include, but are not limited to primary and secondary shredders, cutters, choppers, granulators, grinders, and cracker mills.

Industrial shredding machines are used to shred or reduce objects into smaller pieces for use or recycle. Shredding machines are commonly rotary shredders comprising pairs of counter-rotating, intermeshing, serrating, and shearing blade assemblies or cutting wheels. The blade assemblies are mounted on parallel rotating shafts. The number of pairs of parallel blade assemblies on a single shaft can vary. A larger number of blade assemblies will increase the capacity of the shredder. The parallel blade assemblies are separated by spacers to allow intermeshing of another set of parallel blade assemblies on another shaft.

Many secondary shredders employ a rotor design in which a single rotating head (or rotor) to which blades are mounted is rotated as the larger-sized shreds are fed into the secondary shredder. These rotor-based designs also typically include a number of stationary knives that are positioned in close proximity to the rotating blades thereby forming a shredding interface as the rotor rotates. At the shredding interface, the larger-sized shreds are forced between the rotating blades and the stationary knives, resulting in the shreds being cut/ripped into the small-sized particles. These secondary shredders will also typically have a screen through which appropriately sized particles of material can fall to exit the shredding area and which will cause particles that have not yet been reduced to the appropriate size to be recirculated through the shredding interface.

Cutting machines often include powerful rotating blades or cutters that cut the material components into sections or strips. The sections or strips can be chopped into smaller pieces using a cutting or chopping machine.

Industrial granulator machines are used to reduce the size of material to a finer size, compared to the other machines referenced above. Commercial granulators use a combination of rotor and stator knives operating in a narrow gap against each other to cut the feed material. The rotor knives are affixed to a rotating horizontal shaft. A discharge screen beneath the cutting chamber allows the reduced material to pass when the required size reduction has occurred. Adjusting the hole size can control the size of the granulated output material.

A notable problem with commercially available granulator machines is that a large amount of energy is wasted to rotate the shaft and rotor knives at very high rpm (rotations per minute) within the bed of material being processed. Cutting only occurs at the point of interaction between the rotor and stator knives, yet the rotating shaft churns the material and converts most of the input rotation energy into heat. Adequately cooling conventional granulators can be a serious problem.

It will be appreciated that there is a need in the art for an industrial machine used to reduce the size of solid feed material, which operates efficiently with reduced energy and speed requirements and reduced waste heat generation compared to known machines.

It would be a further advancement in the art to provide a granulator machine which enables the cutting and shearing surfaces to be easily replaced, re-sharpened, and otherwise maintained.

SUMMARY

This disclosure relates to a machine for reducing the size of feed material. The machine may include an infeed hopper sized and configured to receive feed material. Non-limiting examples of feed material that may be reduced in size include rubbers, plastics, wood, cardboard, paper, foams, soft metals such as copper and aluminum, electronics, biomass, and municipal solid waste.

Various embodiments are listed below. It will be understood that the embodiments listed below may be combined not only as listed below, but in other suitable combinations in accordance with the scope of the invention.

The disclosed machine for reducing the size of feed material may include a cutting chamber. In one embodiment, the cutting chamber may be vertically disposed below an infeed hopper to receive the feed material from the infeed hopper.

The disclosed machine for reducing the size of feed material may include a discharge hopper. The discharge hopper may be vertically disposed below the cutting chamber to receive feed material which is reduced in size.

The disclosed machine may reduce the size of feed material by implementing a knife plate comprising a plurality of knife blades disposed within the cutting chamber. Each knife blade comprises a cutting edge and a feed material compression surface. The feed material compression surface extends outward from the cutting edge in a rotation direction. The feed material compression surface extends outward from the cutting edge at a non-horizontal angle from the cutting edge.

In one or more embodiments, each knife blade comprises two cutting edges and two feed compression surfaces. Each feed compression surface may extend outward at an angle from a respective cutting edge.

In one or more embodiments the knife blade cutting edges are coplanar.

The disclosed machine may include a die plate which contacts the plurality of knife blades. The die plate comprises a plurality of holes sized to allow feed material which is reduced in size to pass therethrough into the discharge hopper. The feed material compression surface extends from trailing edge adjacent the cutting edge to a leading edge disposed a vertical height above the die plate.

A drive mechanism rotates the knife plate against the die plate. The drive mechanism comprises a motor and a transmission to control rotation the knife plate about a vertical central axis. The motor may be an electric motor, hydraulic motor, or internal combustion engine. The drive mechanism is preferably selected to rotate the knife plate at a rotation speed adequate to cut, shred, grind, or granulate the feed material to a desired size. The drive mechanism may rotate the knife plate at a relatively slow speed and high torque. The drive mechanism may control the rotation speed and the rotation direction of the knife plate. In one non-limiting embodiment, the drive mechanism may rotate the knife plate at a rotation speed in the range of 1 to 30 rpm. In another non-limiting embodiment, the drive mechanism may rotate the knife plate at a rotation speed in the range of 3 to 20 rpm. In another non-limiting embodiment, the drive mechanism may rotate the knife plate at a rotation speed in the range of 5 to 10 rpm. The drive mechanism operates to rotate the knife plate in two opposing rotation directions (e.g., clockwise and counterclockwise).

In one or more embodiments, the knife plate and the die plate interface in a horizontal plane. In other words, the knife plate and the die plate may be disposed such that the knife plate and the die plate are perpendicular to the cutting chamber and parallel to the ground. The knife plate and the die plate may be in mechanical communication such that the knife plate may freely rotate without creating friction or binding on the die plate. The knife plate may be in physical contact with the die plate or may be disposed slightly above the die plate such that the knife plate may spin and cut materials and force them through the die plate without becoming caught between the knife plate and the die plate.

For example, as the knife plate rotates, feed material is captured in the space between the feed material compression surface and the die plate. The feed material is compressed as it approaches the knife blade and is cut by the interaction of the knife blade cutting edge and the plurality of holes in the die plate. The cut material reduced in size passes through the holes in the die plate to the discharge hopper.

The angled feed material compression surface forces the feed material into the plurality of holes in the die plate to be cut off. The angle of the feed material compression surface can vary depending on the feed material size, the weight of feed material within the infeed hopper compressing the feed material against the die plate, the hardness of the feed material, and the size of holes in the die plate. In a non-limiting embodiment, the angle may range from 1° to 89°. In another non-limiting embodiment, the angle may range from 10° to 45°. In another non-limiting embodiment, the angle may range from 15° to 30°.

In one or more embodiments, the knife blade cutting edges are fabricated of a hardened steel selected from heat treated steel, stainless steel, carbide steel, tool steel, and alloy steel.

In one or more embodiments, the die plate is fabricated of a hardened steel selected from heat treated steel, stainless steel, carbide steel, tool steel, and alloy steel.

The number of holes and size of the holes in the die plate is only limited by the practical working area of the die plate and the knife plate. The number of holes and the corresponding size of the holes can be increased as the working area of the die plate and knife plate increases. More holes or openings in the die plate allow more feed material to be forced into the holes and for the knife blade cutting edges on the same plane to cut off the pieces of feed material being pushed into the holes.

When larger size holes are used in the die plate, machine may roughly chop or shred material (e.g., chop or shred material into larger pieces which may be more easily shredded by a die plate with smaller holes). In some embodiments, the machine may reduce the size of feed material with a die plate which may include a plurality of holes with a hole size in the range of 25 mm to 300 mm. The machine may further reduce the size of feed material, with a die plate which may include a plurality of holes with a hole size in the range of 10 mm to 50 mm. Similarly, the machine may reduce the size of feed material with a die plate which may include a plurality of holes with hole size in the range of 1 mm to 10 mm, and more preferably between 3 mm to 8 mm.

It is within the scope of the disclosure to use more than one machine in series to reduce the size of feed material. When used in series, the first machine may use larger size holes in the die plate, and subsequent machines may use smaller size holes in the die plate until the desired feed material size reduction is achieved. In this manner material fed into a first machine may be chopped to a certain size and discharged to a second machine which may further reduce the size of chopped material to a smaller size and continued with additional machines until the desired size is achieved.

The holes in the die plate may take any desired geometric shape including, but not limited to, round, square, rectangle, triangle, hexagon, octagon, oval, and elliptical. Some factors considered in determining hole shape include, but are not limited to, greater shearing power, higher output efficiency, amount of open area needed, and more efficient material sizing. The plurality of holes can be arranged on the die plate in any desired hole pattern. In some embodiments, the hole pattern is selected to achieve the greatest amount of open space on the die plate.

In operation, as the knife plate is rotated, the feed material is compressed and forced into the plurality of holes in the die plate. The rotating knife blade cutting edge interacts with the feed material against one side of the holes in the die plate to cut the feed material. Hence, as the knife plate rotates in one direction, one side of the holes in the die plate acts as a cutting edge with the knife blade cutting edge. After extended use of the machine, the cutting edge of the knife blade and holes become worn. By reversing the rotation direction of the knife plate, a second set of knife blade cutting edges and hole cutting edges may be used. When these secondary cutting edges become worn, the entire knife plate and die plate may be re-sharpened for further use.

BRIEF DESCRIPTION OF THE DRAWINGS

In order that the manner in which the above-recited and other features and advantages of the disclosure are obtained will be readily understood, a more particular description of the machine briefly described above will be rendered by reference to specific embodiments thereof that are illustrated in the appended drawings. Understanding that these drawings depict only typical embodiments of the machine and are not therefore to be considered to be limiting of its scope, the machine will be described and explained with additional specificity and detail through the use of the accompanying drawings in which.

DETAILED DESCRIPTION OF THE INVENTION

The present embodiments of the disclosed machine will be best understood by reference to the drawings, wherein like parts are designated by like numerals throughout. It will be readily understood that the components of the machine, as generally described and illustrated in the figures herein, could be arranged and designed in a wide variety of different configurations. Thus, the following more detailed description of the machine for reducing the size of feed material, is not intended to limit the scope of the claims, but is merely representative of illustrative embodiments of the machine.

Figure 1A:
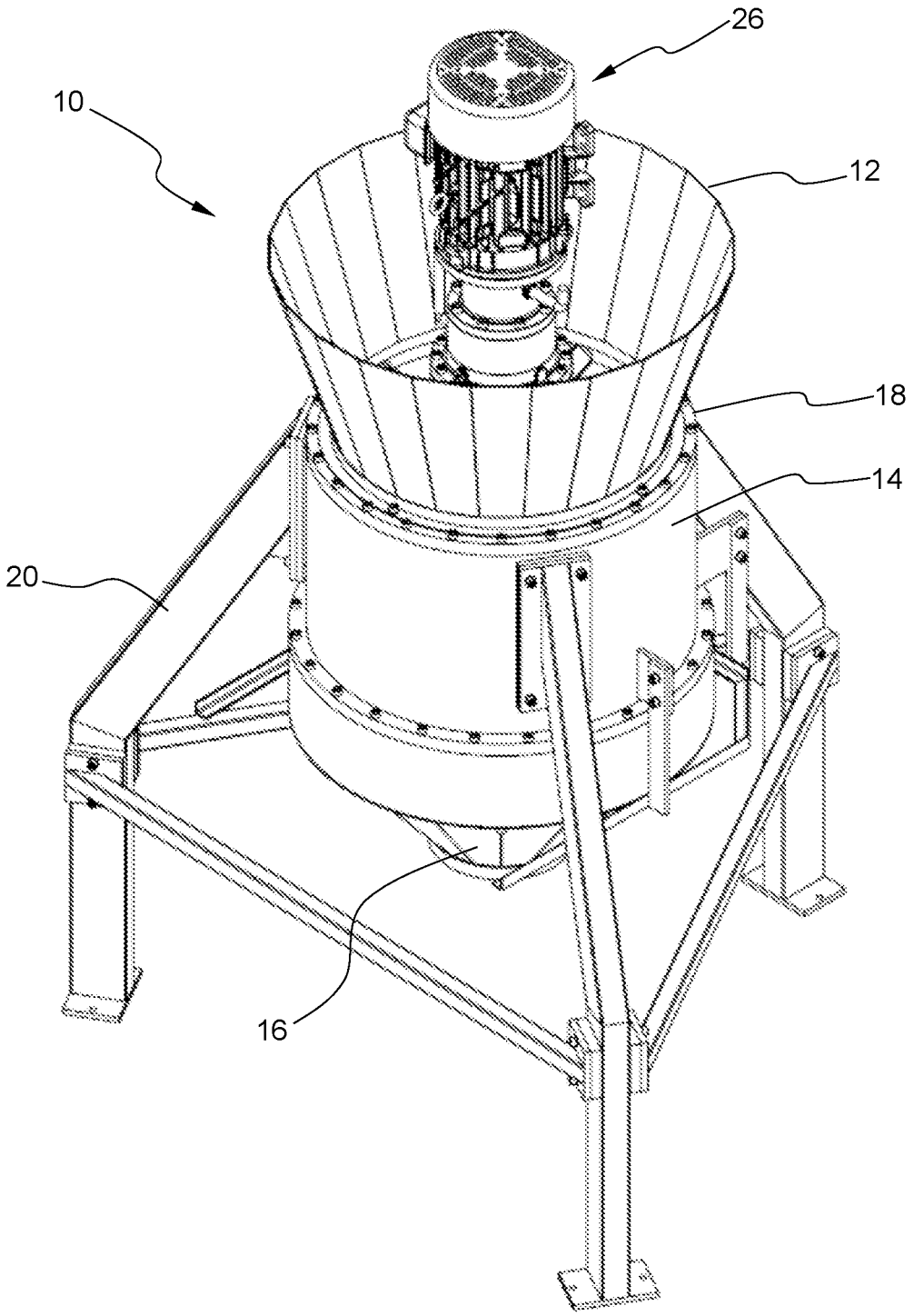
FIGS. 1A and 1B are front perspective and front elevation views, respectively, of a machine for reducing the size of feed material.
Figure 1B:
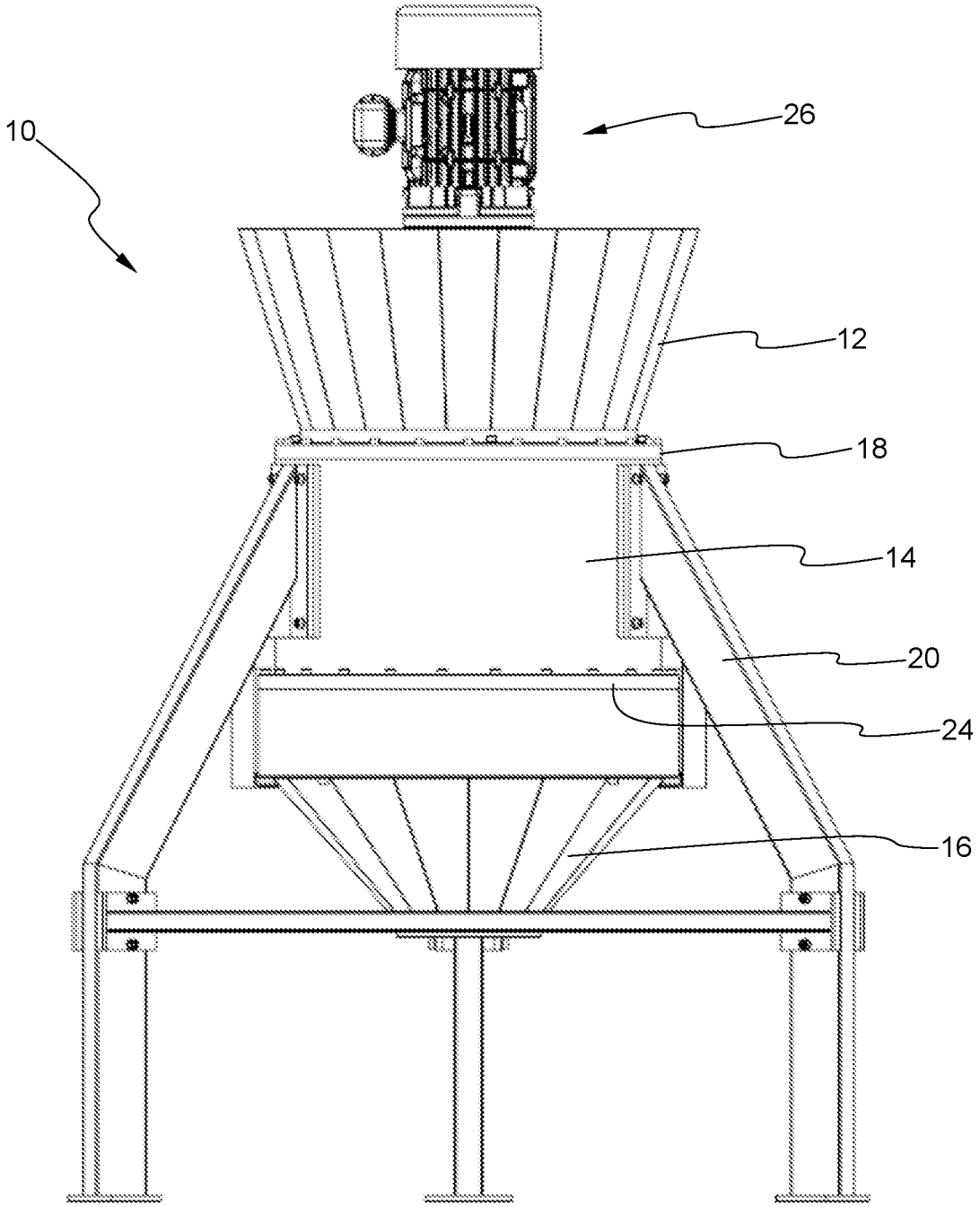

FIGS. 1A and 1B show an embodiment of a machine 10 for reducing the size of feed material. The machine 10 includes an infeed hopper 12 sized and configured to receive feed material. Non-limiting examples of feed material that may be reduced in size include rubbers, plastics, wood, cardboard, paper, foams, soft metals such as copper and aluminum, electronics, biomass, and municipal solid waste.

The machine 10 includes a cutting chamber 14 vertically disposed below the infeed hopper 12 to receive the feed material from the infeed hopper.

The machine 10 includes a discharge hopper 16 vertically disposed below the cutting chamber 14 to receive feed material which is reduced in size.

The machine 10 is supported by a support frame 18 and a plurality of legs 20.

Figure 2:
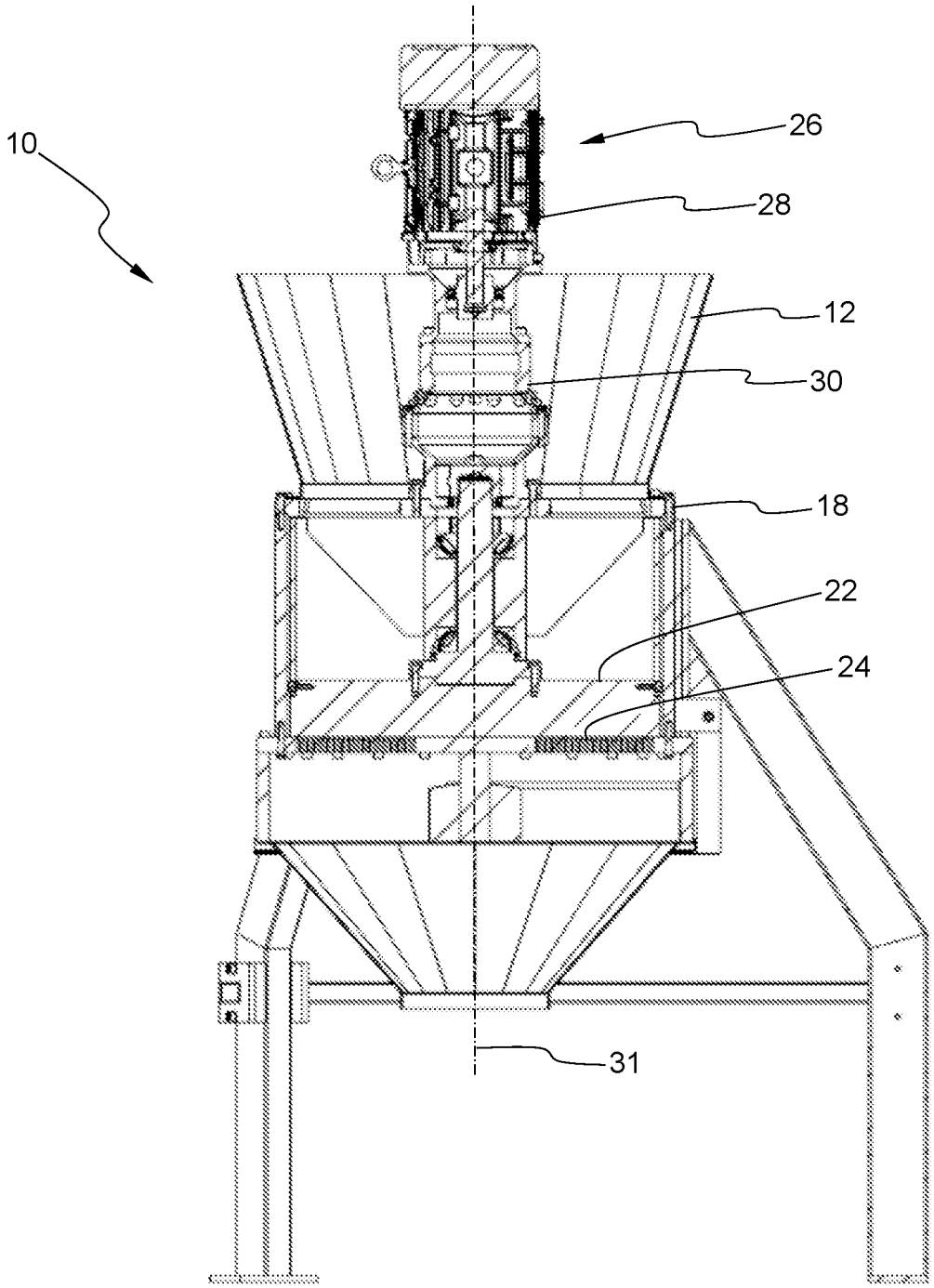
FIG. 2 is a cut-away side view of the machine.

FIG. 2 shows a sectional view of the machine 10. The machine 10 includes a knife plate 22 disposed within the cutting chamber 14.

The machine 10 includes a die plate 24 which contacts the knife plate 22.

A drive mechanism 26 rotates the knife plate 22 against the die plate 24. The drive mechanism comprises a motor 28 and a transmission 30 to control rotation of the knife plate about a vertical central axis 31. The motor 28 may be an electric motor, hydraulic motor, or internal combustion engine. In one or more embodiments, the motor may produce a power in the range of 5 to 10 horsepower. This is significantly lower than many commercially available machines for reducing the size of comparable feed material, which may require motors having ten or more times the horsepower.

The drive mechanism 26 is preferably selected to rotate the knife plate 22 at a relatively slow speed and high torque. The drive mechanism 26 controls the rotation speed and the rotation direction of the knife plate 22. The drive mechanism 26 may rotate the knife plate 22 at any rotation speed suitable for the feed material being reduced in size, the size of the holes in the die plate 24, and the diameter of the knife plate 22. The rotation speed of the knife plate is controlled to cut, shred, grind, or granulate the feed material to a desired size. Typically, for a given diameter of the knife plate 22, the rotation speed (rpm) will be slower for hard and difficult to cut feed material compared to soft and easy to cut feed material. For a given rotation speed, the diameter of the knife plate 22 directly affects the tip speed at the circumference of the knife plate. For instance, for a given rotation speed, doubling the diameter of the knife plate will double the tip speed of the knife plate. For a very large diameter knife plate 22, the rotation speed may be lower, even less than 1 rpm, to account for the increased rip speed of the knife plate or increased hole size in the die plate 24.

In one non-limiting embodiment, the drive mechanism 26 may rotate the knife plate at a rotation speed in the range of 1 to 30 rpm. In another non-limiting embodiment, the drive mechanism 26 may rotate the knife plate at a rotation speed in the range of 3 to 20 rpm. In another non-limiting embodiment, the drive mechanism 26 may rotate the knife plate 22 at a rotation speed in the range of 5 to 10 rpm. The drive mechanism operates to rotate the knife plate in two opposing rotation directions.

It is within the scope of the disclosed invention to provide the drive mechanism 26 with sensors (not shown) to detect application of too much torque, which may indicate a blockage of the holes and knife plate 22. If blocked, the drive mechanism 26 may automatically reverse direction of the knife plate 22 to clear the blockage.

Figure 3:
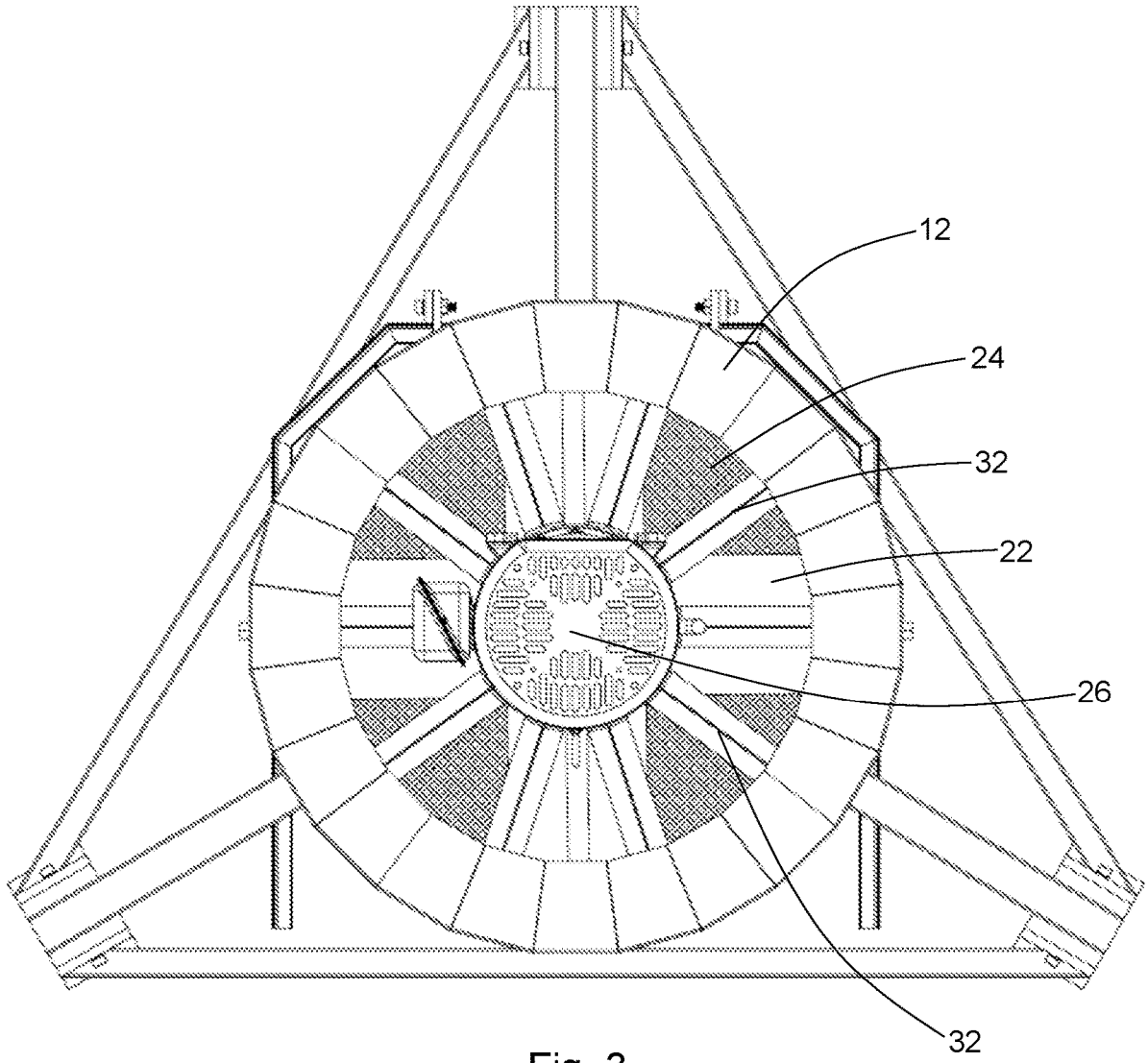
FIG. 3 is a top plan view of the machine.

FIG. 3 shows a top plan view of the machine 10. The support frame 18 includes a plurality of support bars 32 to support the drive mechanism 26 within the vertical central axis. The support bars 32 may extend from an outer periphery at a transition between the infeed hopper 12 and cutting chamber 14.

Figure 4A:
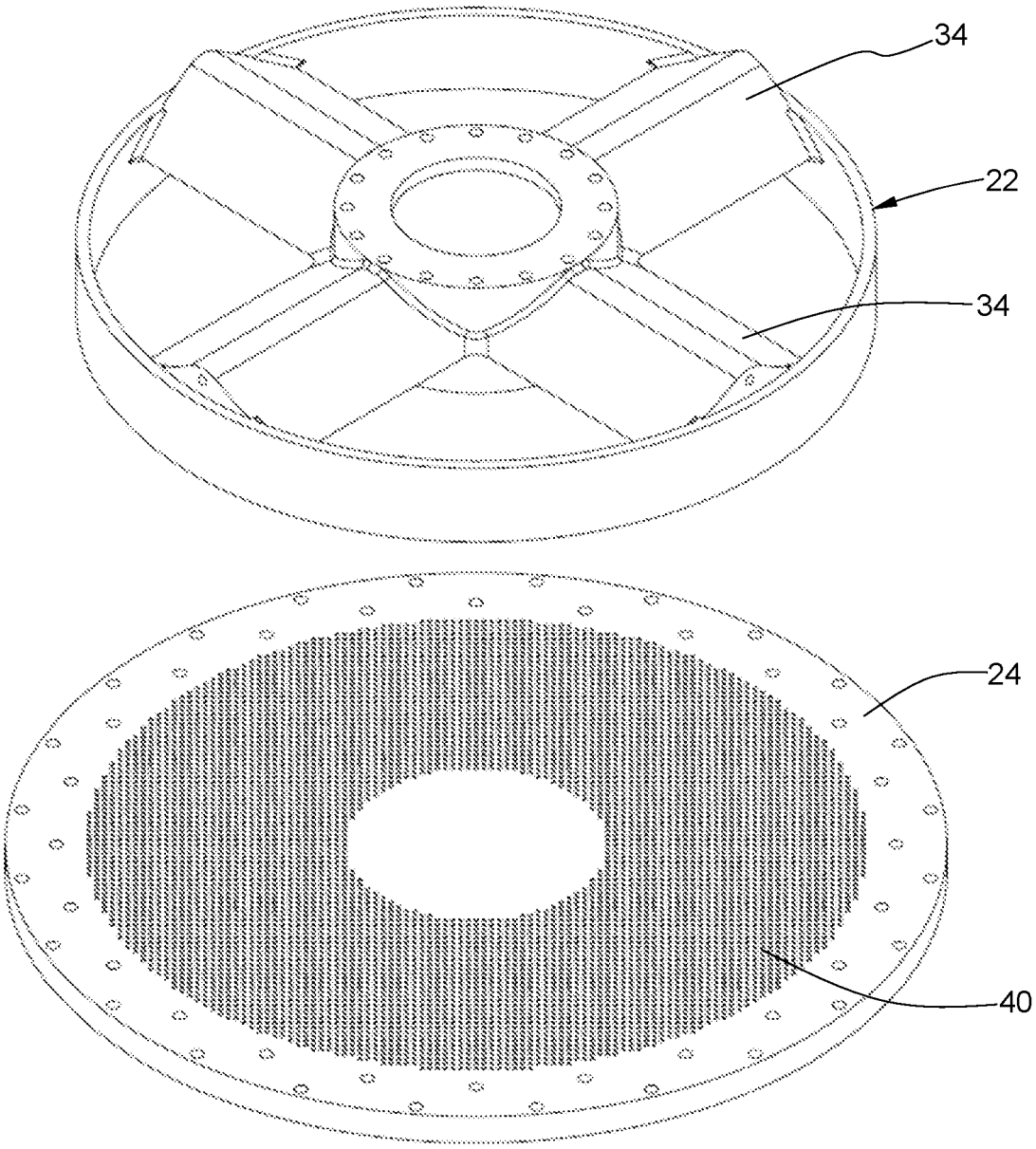
FIGS. 4A and 4B are top perspective and bottom perspective views, respectively, of a knife plate and die plate within the scope of the disclosed invention.
Figure 4B:
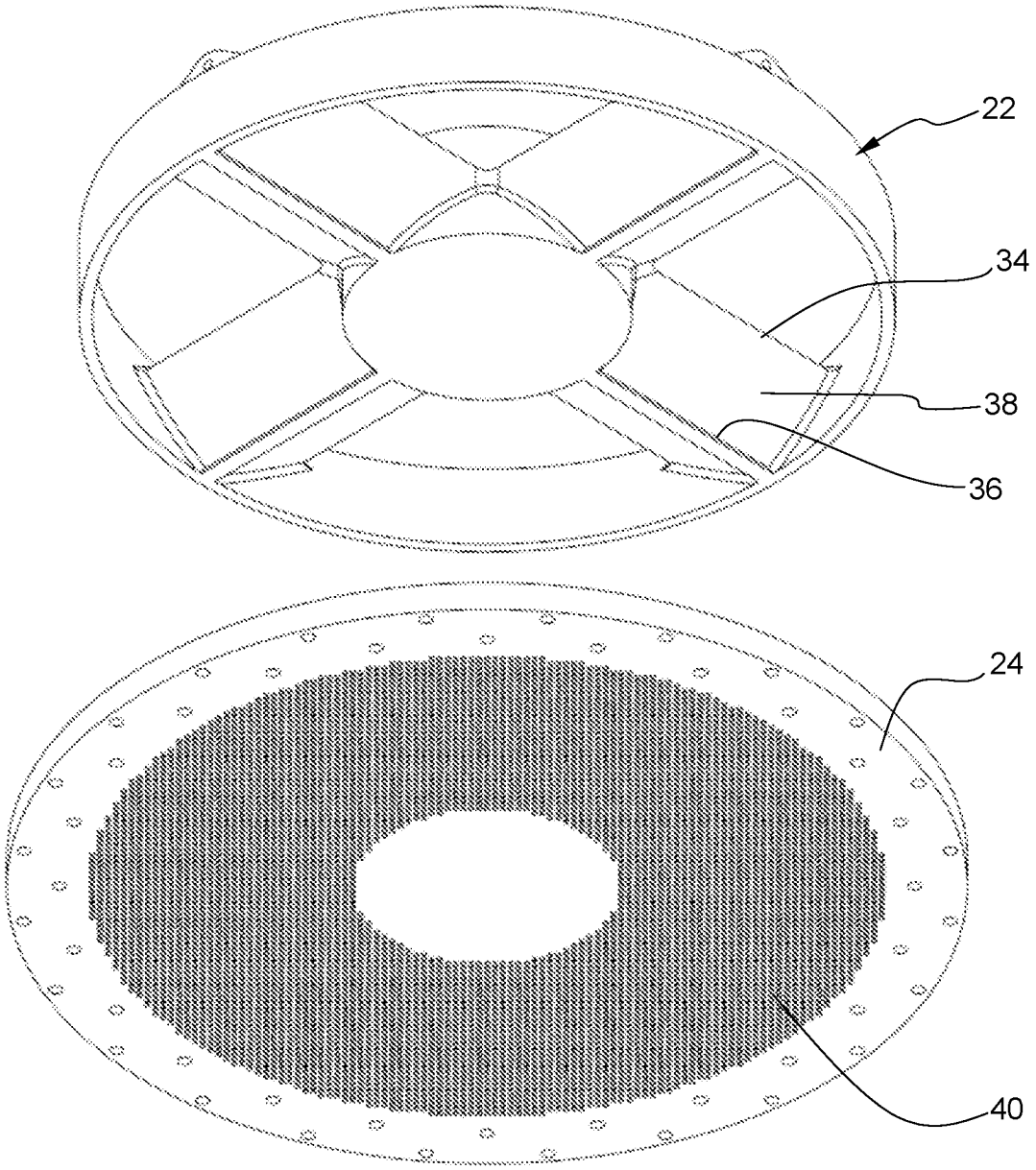

FIG. 4A discloses a top, exploded perspective view of the knife plate 22 and die plate 24. FIG. 4B discloses a bottom, exploded perspective view of the knife plate 22 and die plate 24. The knife plate 22 comprises a plurality of knife blades 34. The embodiment shown in FIGS. 4A and 4B includes four knife blades. The number of knife blades 34 may vary depending upon the size of the feed material fed into the machine 10 and the diameter of the knife plate 22. For instance, a machine 10 having a knife plate 22 with a diameter of 2 meters can accommodate more knife blades 34 than a machine having a diameter of 1 meter. The knife blades 34 may, but need not, extend the full radius of the knife plate 22. It is within the scope of the disclosed invention to include knife blades 34 which extend only a partial radius of the knife plate 22. For example, one or more knife blades 34 may extend from a circumference of knife plate 22 in towards a center of the knife plate which may or may not connect with a center of knife plate 22. In another embodiment, a plurality of knife blades 34 may extend from a center of knife plate 22, where at least one or more of knife blades 34 have a first length, at least one or more of knife blades 34 have a second length, at least one or more of knife blades 34 have a third length and etc., where each of the first length, the second length, the third length, and subsequent lengths are different. Knife blades 34 may similarly extend from the circumference of knife plate 22 towards the center of knife plate 22 in a similar fashion, where one or more knives each have a different length extending towards the center of knife plate 22. In this manner, knife blades 34 may be disposed such that each of the plurality of holes 40 in die plate 24 may constantly receive feed material as knife plate 22 spins. Die plate 24 may include a plurality of holes 40. The plurality of holes 40 may include at least one, but preferably, at least two or more sharpened faces, depending on the orientation of one particular hole in the plurality of holes 40. That is at least one or more sides of each hole in the plurality of holes 40 may be sharpened such that as feed material passes in a first direction, the sharpened faces of each of the plurality of holes 40 cut material in die plate 24. Similarly, when the feed material passes in a second direction, opposite sharpened faces of each of the plurality of holes 40 cut material in die plate 24. Thus, preferably, the two or more sharpened faces of each of the plurality of holes 40 may be positioned on opposing sides of each one of the plurality of holes 40. In one embodiment, die plate 24 may be made using mild steel for milling and the sharpening of each of the plurality of holes 40. Die plate 24 may be then case hardened using conventional metallurgy techniques.

In one or more non-limiting embodiments, the number of knife blades ranges from 2 to 100. In another non-limiting embodiment, the number of knife blades ranges from 4 to 10.

As shown in FIG. 4B, each knife blade 34 comprises a cutting edge 36 and a feed material compression surface 38. In one or more embodiments, each knife blade 34 comprises two cutting edges 36 (shown in FIG. 5A as cutting edges 36A and 36B) and two feed material compression surfaces 38, yet only one knife blade and one feed material compression surface is active based upon the direction the knife blade is rotated. In other words, if the knife blade rotates in a forward direction, only the cutting edge and feed material compression surface in the forward rotation direction are operational. If the knife blade rotates in a reverse direction, only the cutting edge and feed material compression surface in the reverse direction are operational.

The knife plate 22 and the plurality of knife blades 34 contact the die plate 24. The die plate 24 comprises a plurality of holes 40 sized to allow feed material which is reduced in size to pass therethrough into the discharge hopper 16.

In an embodiment, the knife blade cutting edges 36 are fabricated of a hardened steel selected from heat treated steel, stainless steel, carbide steel, tool steel, and alloy steel.

In an embodiment, the die plate 24 is fabricated of a hardened steel selected from heat treated steel, stainless steel, carbide steel, tool steel, and alloy steel.

The number of holes 40 and size of the holes 40 in the die plate 24 are only limited by the practical working area of the die plate 24 and the knife plate 22. The number of holes 40 and the corresponding size of the holes can be increased as the working area of the die plate 24 and knife plate 22 increases. More holes or openings in the die plate allow more feed material to be forced into the holes and for the knife blade cutting edges on the same plane to cut off the pieces of feed material being pushed into the holes.

When larger size holes are used in the die plate 24, the machine 10 may roughly chop or shred material (e.g., chop or shred material into larger pieces which may be more easily shredded by a die plate with smaller holes). In some embodiments, machine 10 may reduce the size of feed material with a die plate which may include a plurality of holes with a hole size in the range of 25 mm to 300 mm. Machine 10 may further reduce the size of feed material, with a die plate which may include a plurality of holes with a hole size in the range of 10 mm to 50 mm. Similarly, machine 10 may reduce the size of feed material with a die plate which may include a plurality of holes with hole size in the range of 1 mm to 10 mm, and more preferably between 3 mm to 8 mm.

In one embodiment, feed materials that have gone through a preliminary size-reduction process may be fed into a machine with smaller holes. Feed materials that have not been previously reduced in size may require larger holes in order to cut the material down from such a large size. In one embodiment, multiple machines with progressively smaller hole sizes may be used in series. It is within the scope of the disclosed invention to use more than one machine in series to reduce the size of feed material. When used in series, the first machine would use larger size holes in the die plate, and subsequent machines would use smaller size holes in the die plate until the desired feed material size reduction is achieved. In another embodiment, it is possible to use a plurality of knife plates 22 in combination with a plurality of die plates 24 which may all be positioned in a cutting chamber and drive by the same driving mechanism 26 (shown in FIG. 1). In this manner, large material may be cut into smaller material and then cut into even smaller material as material passes through each die plate to a subsequent knife plate 22 and die plate 24. Any number of knife plates 22 and die plates 24 may be disposed in such a configuration to allow several stages at which a size of material may be reduced until a final size is reached. Each of the knife plates 22 in this configuration may be connected by a shaft from transmission 30 (shown in FIG. 1) which may drive each of the knife plates 22 into contact with die plates 24 to cut material as disclosed herein.

The holes 40 can take any desired geometric shape including, but not limited to, round, square, rectangle, triangle, hexagon, octagon, oval, and elliptical. Some factors considered in determining hole shape include, but are not limited to, greater shearing power, higher output efficiency, amount of open area needed, and more efficient material sizing. Different hole shapes create different shaped granules for different industries. Different hole shapes change the shear points and compression time on the feed material before it cuts. Different hole shapes change the amount of open space in the die plate to increase output capacities. The plurality of holes 40 can be arranged on the die plate 24 in any desired hole pattern. In some embodiments, the hole pattern is selected to achieve the greatest amount of open space (e.g., space through which material may pass) on the die plate 24.

Figure 5:
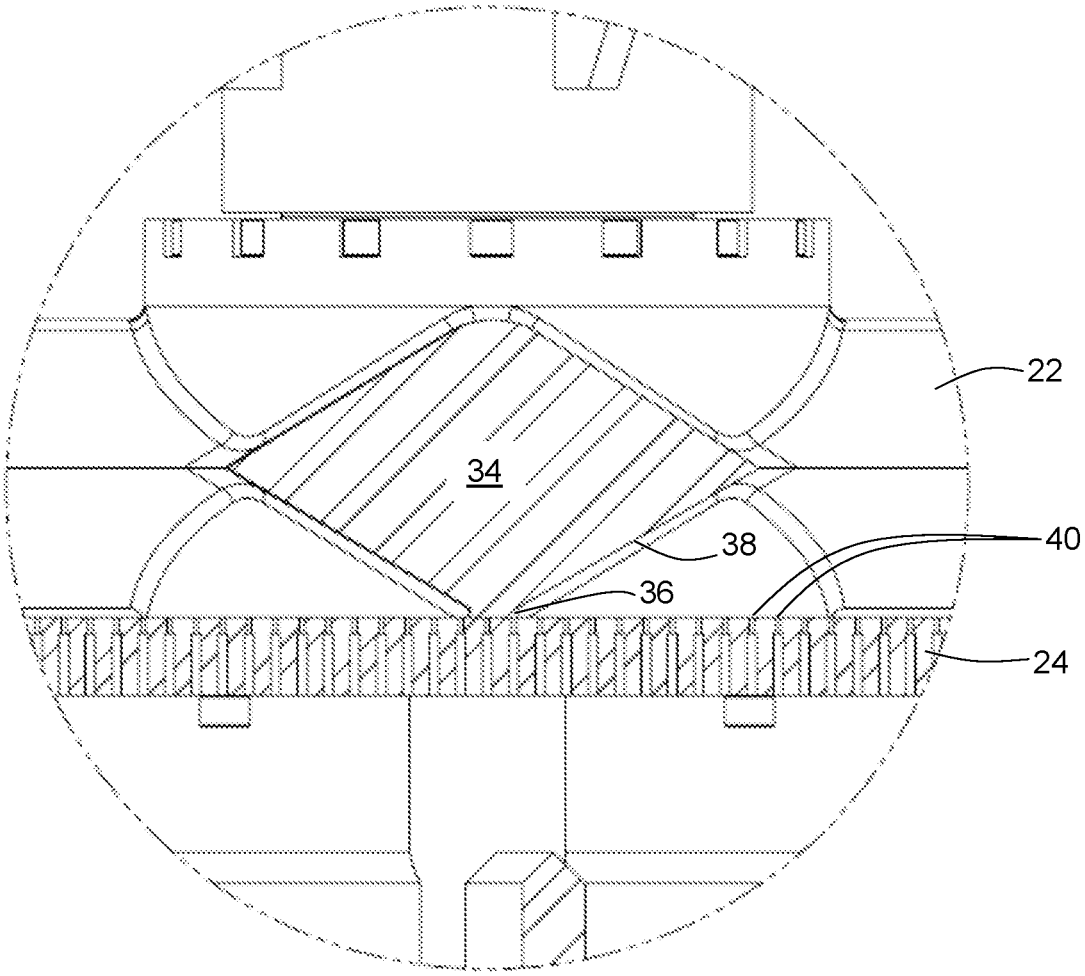
FIGS. 5 and 5A are enlarged cross-sectional details of the knife plate and die plate interface.
Figure 5A:
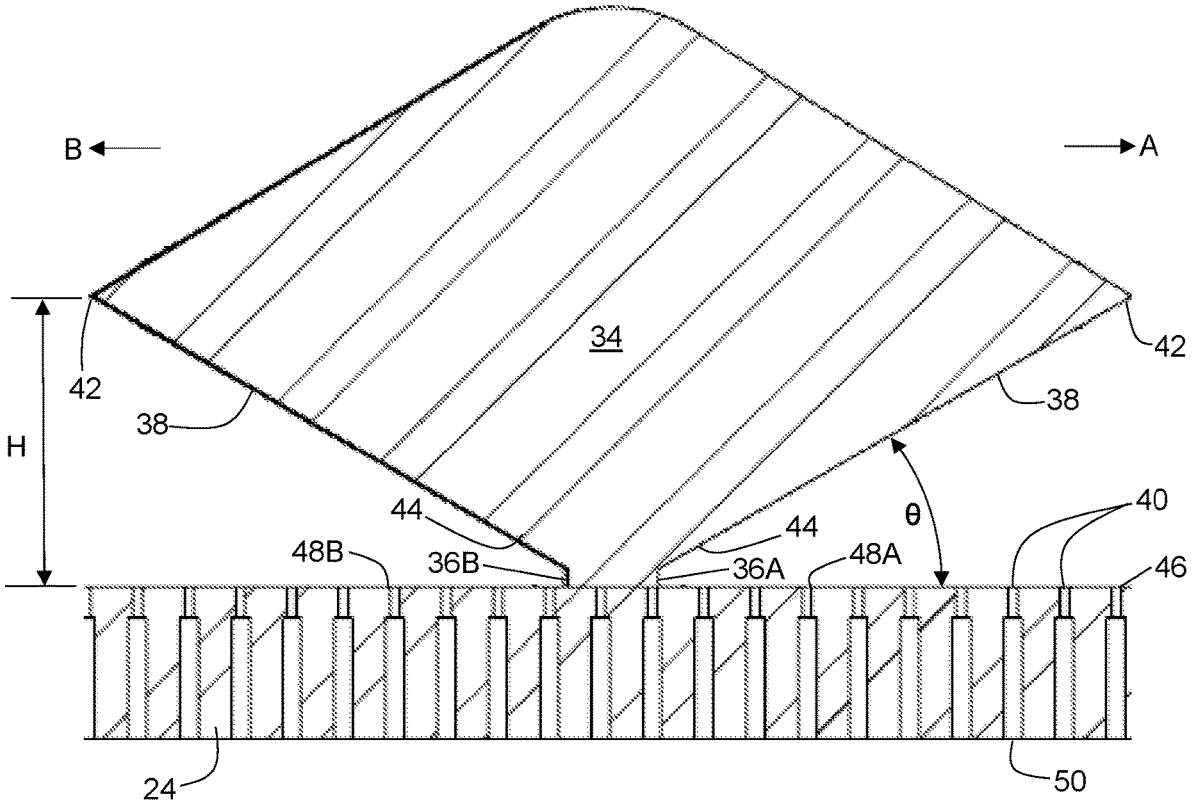

FIGS. 5 and 5A are enlarged cross-sectional views of the interface between the knife plate 22 and die plate 24. The feed material compression surface 38 has a leading edge 42 and a trailing edge 44. The feed material compression surface 38 extends from the trailing edge 44, adjacent the cutting edge 36, to the leading edge 42.

The feed material compression surface 38 extends outward at a non-horizontal angle θ relative to an impact surface 46 of the die plate 24. The angle θ of the feed material compression surface 38 can vary depending on the feed material size, the weight of feed material within the infeed hopper 12 compressing the feed material against the die plate 24, the hardness of the feed material, and the size of holes 40 in the die plate 24. In a non-limiting embodiment, the angle θ may range from 1° to 89°. In another non-limiting embodiment, the angle θ may range from 10° to 45°. In yet another non-limiting embodiment, the angle θ may range from 15° to 30°. The amount of compression needed to force the feed material into the holes 40 affects the angle θ of the feed material compression surface 38. A larger angle θ will produce less compression compared to a smaller angle θ. If the weight of the feed material within the infeed hopper 12 is sufficient to compress the feed material against the die plate 24, then a larger angle θ may be used.

The leading edge 42 of the feed material compression surface 38 is disposed at a vertical height "H" above the impact surface 46 of die plate 24. Size of the feed material being fed into machine 10 determines the desired height "H". The feed material, may in one embodiment, have a size less than the height "H". In another embodiment, leading edge 42 of knife blade 34 may also be sharpened and may also "pre-cut" larger pieces of material before the material encounters compression surface 38 and is forced by pressure into the plurality of holes 40 within die plate 24. As one example, height "H" may be positioned to be 6 inches above impact surface 46. As knife plate 22 rotates, leading edge 42 may encounter feed material stacked on top of knife blade 34 or other material and cut the material prior to the material encountering compression surface 48 and die plate 24. Leading edge 42 may facilitate the efficiency of the machine 10 by pre-sizing or pre-cutting material before the material is cut by cutting edges 36A and 36B (depending on rotation direction of knife plate 22). In any case height "H" may be selected to pre-size or pre-cut material prior to the material encountering feed material compression surface 38 and die plate 24.

Without being bound by theory, as the knife plate 22 and knife blades 34 rotate, feed material is captured in the space between the feed material compression surface 36 and the die plate impact surface 46. The feed material compression surface 38 compresses the feed material and forces a portion of the feed material into the plurality of holes 40 in the die plate 24. The portion of feed material disposed within holes 40 is cut by cutting edge 36A or 36B as the knife blade 34 rotates against the die plate 24. The cut material, which is reduced in size, passes through the holes 40 in the die plate 24 to the discharge hopper 16 (shown in FIG. 1). In practice, compression exerted by compression surface 38 forces material into the plurality of holes 40 across die plate 24. As the material is cut by interaction of cutting edges 36A or 36B, the size of the material to be cut is reduced by die plate 24 and is pushed closer and closer to trailing edge 44 by larger material cut by leading edge 42 as that material encounters compression surface 38 just behind leading edge 42.

The speed and the angle of the plate can be altered to get the proper size material output.

In an embodiment shown best in FIG. 5A, each knife blade 34 comprises two cutting edges 36A and 36B and two feed compression surfaces 38. Each feed compression surface 38 extends outward at an angle from a respective cutting edge 36. As the knife blade 34 rotates in one direction "A", the feed material is cut by the interaction of one cutting edge 36A and one side 48A of the plurality of holes 40. Side 48A of the plurality of holes 40 may be sharpened to facilitate the cutting of material in direction A, as previously discussed. Side 48A may further incorporate one or more physical sides of the plurality of holes 40 depending on a shape or size of the plurality of holes 40 in die plate 24. After a period of extended use in direction "A", it is expected that the cutting edge 36A and hole sides 48A will become worn and dull. In that situation, the knife plate 22 and knife blades 34 may be rotated in the opposite direction "B", and the feed material may be cut by the interaction of cutting edge 36B and hole sides 48B. Side 48B of the plurality of holes 40 may also be sharpened to facilitate the cutting of material in direction B, as previously discussed. Side 48B may further incorporate one or more physical sides of the plurality of holes 40 depending on a shape or size of the plurality of holes 40 in die plate 24.

When cutting edges 36A, 36B become worn, the knife blade cutting edges 36 can be re-sharpened. Similarly, when the hole sides 48A and 48B become worn, the impact surface 46 of the die plate 24 may be restored by resharpening hole sides 48A and 48B.

In an embodiment the knife blade cutting edges 36 are coplanar.

In an embodiment, the knife plate 22 and the die plate 24 interface by a plane defined by die plate 24. In one embodiment, the plane defined by die plate 24 may be a horizontal plane. It should be noted that while a vertically oriented machine 10 and cutting chamber 14 may be preferable, machine 10 disclosed herein is not limited to only vertical applications. The same techniques may be used in a horizontal direction to produce similar results using other feeding apparatuses including a worm drive feeder, a pressurized feeder, or even in a less efficient example, a conveyor belt.

In an embodiment one or more of the plurality of holes 40 have a cross-sectional diameter that is smaller at the impact surface 46 and larger at an opening 50 to the discharge hopper 16 to prevent material build up in the plurality of holes by decreasing friction in the larger opening 50.

Compared to commercially available machines for reducing the size of feed material, it is estimated that one or more embodiments of the disclosed machine may operate at an efficiency of about 98%, while commercially available machines may operate at an efficiency of about 2%. As used herein, efficiency is a measure of energy and wear costs compared to equipment output. In other words, efficiency is a measure of the cost per ton to produce the desired product.

While specific embodiments and examples of the present invention have been illustrated and described, numerous modifications come to mind without significantly departing from the spirit of the invention, and the scope of protection is only limited by the scope of the accompanying claims.

The invention claimed is:

1. A machine, comprising:

a motor;

a transmission;

a knife plate driven by the motor via the transmission, the knife plate including a plurality of knife blades, each knife blade including a leading edge and one or more cutting edges;

a die plate, the die plate including a plurality of sharpened holes and interfacing with the one or more cutting edges of the plurality of knife blades at a surface of the die plate with the one or more cutting edges of the plurality of knife blades, wherein the leading edge of the plurality of knife blades is disposed above the surface of the die plate and is connected to the one or more cutting edges of the plurality of knife blades by a feed material compression surface, wherein the feed material compression surface is disposed at a non-horizontal angle relative to the die plate and extends from the one or more cutting edges to a height of the plurality of knife blades.

2. The machine of claim 1, wherein the plurality of knife blades each include a second feed material compression surface.

3. The machine of claim 2, wherein the second feed material compression surface is disposed at an angle to the one or more cutting edges of each of the plurality of knife blades.

4. The machine of claim 1, wherein the first leading edge is a sharpened edge.

5. The machine of claim 4, wherein the first leading edge of the knife blade is disposed at the height above the die plate.

6. The machine of claim 4, wherein a bottom of the first leading edge begins the first feed material compression surface.

7. The machine of claim 4, wherein each of the plurality of the knife blades includes a second leading edge.

8. The machine of claim 7, wherein the second leading edge begins a second compression surface.

9. The machine of claim 1, wherein the one or more cutting edges of each of the plurality of the knife blades are disposed to compress material through die plate.

10. The machine of claim 1, wherein the plurality of sharpened holes in the die plate include one or more sharpened surfaces.

11. The machine of claim 1, wherein the plurality of sharpened holes in the die plate include two or more sharpened surfaces.

12. The machine of claim 11, wherein the two or more sharpened surfaces are on opposing sides of the plurality of holes.

13. The machine of claim 1, wherein the die plate includes a hole of a first diameter.

14. The machine of claim 13, wherein the hole of the first diameter connects to a hole of a second diameter in the die plate.

15. The machine of claim 1, wherein the motor, the transmission, the knife plate, and the die plate are all centered about a vertical axis.

16. The machine of claim 1, wherein at least the knife plate and the die plate are disposed within a cutting chamber of the machine.

17. The machine of claim 1, wherein the machine includes one or more of an infeed hopper and a discharge hopper.

* * * * *